US005749197A

United States Patent [19]

Jolly

[11] Patent Number: 5,749,197

[45] Date of Patent: May 12, 1998

[54] PANEL JOINT SYSTEM

[75] Inventor: Colin Kenneth Jolly, Southampton, England

[73] Assignee: Reddie & Grose, Hampshire, United Kingdom

[21] Appl. No.: 786,136

[22] Filed: Jan. 21, 1997

[51] Int. Cl.[6] ..... E04B 1/38

[52] U.S. Cl. ..... 52/584.1; 52/582.1; 52/586.1; 52/285.2; 52/309.9; 52/309.11; 52/468

[58] Field of Search ..... 52/584.1, 586.1, 52/582.1, 309.9, 309.11, 461, 463, 464, 468, 285.2

[56] References Cited

U.S. PATENT DOCUMENTS 2,822,898 2/1958 Richards ..... 52/468 X
3,153,692 10/1964 Lindgren ..... 52/463 X
3,267,631 8/1966 Hammitt ..... 52/584.1 X
4,158,938 6/1979 Meechan et al. ..... 52/584.1 X
4,936,069 6/1990 Hunter et al. ..... 52/586.1 X

*Primary Examiner*—Robert Canfield
*Attorney, Agent, or Firm*—Nixon & Vanderhye

[57] ABSTRACT

Panel members each have a panel body which is disposed between a pair of planar facing members. The panel members are secured together edge-to-edge by means of first and second channel members each of which has a pair of arms joined by means of a web. The arms of each channel member engage in troughs formed along the edges of the facing members of each of two adjacent panel members. The assembly is secured by fastening means which extend between the panel members to fasten together the channel members. The resulting joint is rigid and fire-resistant and provides maximum thermal resistance.

8 Claims, 2 Drawing Sheets

Fig. 2
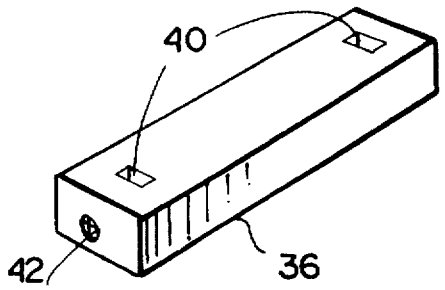
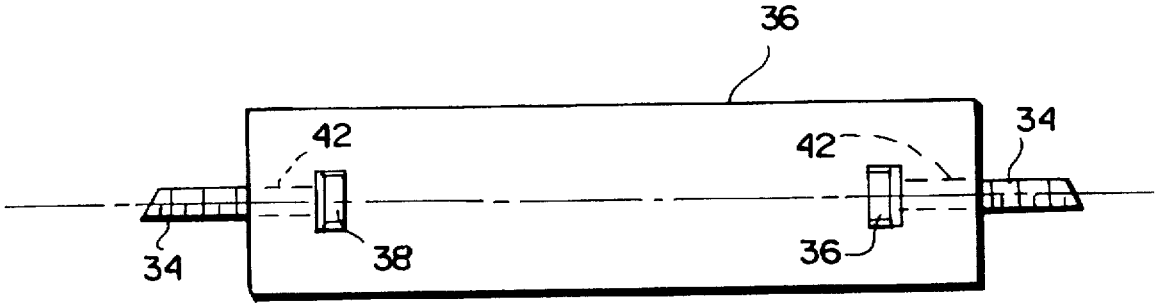
Fig. 3

PANEL JOINT SYSTEM

BACKGROUND OF THE INVENTION

This invention relates to a panel system comprising a plurality of panel members each of which comprises a panel body disposed between and secured to a pair of planar facing members, and means for securing adjacent panel members together. The system is particularly suitable for the connection of panels used as thermally insulating panels, fire-resistant panels and the like used in temperature controlled environments or where fire-resistant constructions are required. Examples of such panel systems are described, in U.S. Pat. No. 4,354,028 and German Patent document DE-B-1 025 493.

OBJECTS OF THE INVENTION

It is an object of the invention to provide a panel system which is designed to achieve the following aims with the fewest separate components:

a) maintenance of a virtually flush surface, b) a clamping action to assist in holding the panel faces in position both laterally and transversely under all conditions, but most particularly during a fire, and c) minimal thermal-bridging with maximum thermal resistance through the joint.

SUMMARY OF THE INVENTION

The panel system of the invention comprises a plurality of panel members, each of which comprises a panel body disposed between and secured to a pair of planar facing members; each of said facing members being shaped so as to define a trough extending along at least one edge surface of said panel body and opening towards the face of the panel body to which said facing member is secured. There are provided means for securing adjacent panel members together edge-to-edge; said means for securing said panel members including first and second channel members each having a pair of arms joined by means of a web, the arms of each channel member, in use, engaging one in each of the troughs formed along the adjacent edge surfaces of a pair of neighbouring panel members. Said means for securing adjacent panel members together further comprise first and second fastening means engageable with the first and second channel members respectively and with an insulating spacer, the first and second fastening means and the insulating spacer together extending between neighbouring panel members to fasten together the channel members on opposite sides thereof.

In a preferred embodiment said first or second fastening means comprises a threaded member having a first threaded end portion which, in use, passes through an opening formed in the respective first or second channel members, said first end portion being threaded for engagement with a retaining nut and a second end portion which is engageable with said insulating spacer. Said first or second fastening means may include a second threaded end portion which, in use, passes through a bore formed in said insulating spacer and engages with a retaining nut located in a recess formed therein.

BRIEF DESCRIPTION OF THE DRAWINGS

An embodiment of the invention will now be described in detail, by way of example, with reference to the drawings, in which:

FIG. 2 is a perspective view of an insulating block which forms part of the panel connection shown in FIG. 1; and FIG. 3 is a plan view of the insulating block of FIG. 2.

DETAILED DESCRIPTION OF A PREFERRED EMBODIMENT

Figure 1:
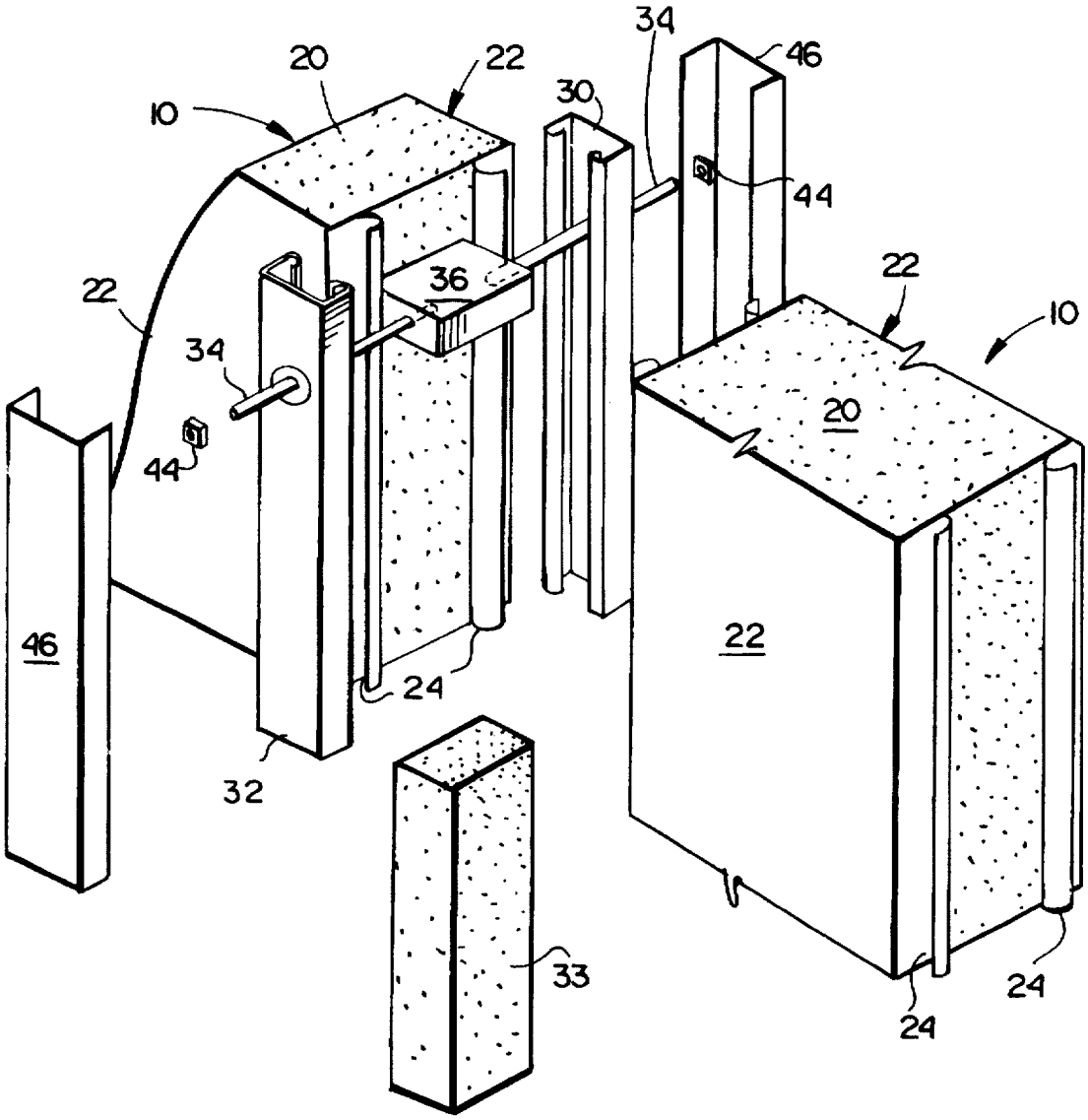
FIG. 1 is an exploded perspective view of a panel connection in accordance with the invention.

As shown in the drawings, the system comprises a plurality of panels 10 which are held in position by means of channel members 30 and 32.

Each panel 10 is a composite sandwich which consists of a flat block 20 of insulating core material having, on each of its two faces, metal sheets 22.

The core material of the panels is a relatively rigid, hard core composite of a kind suitable for use in constructing temperature controlled environments and may additionally be fire-resistant.

The sheet metal 22 on each face of the composite sandwich panel 10 is cold-formed around the edge corners of the core material 20 to provide both protection and integral edge stiffening, in a manner which is well-known. The sheet metal 22 is further shaped to form integral troughs 24 shown in FIG. 1 which extend longitudinally along the full length of the panel edges which are to be joined. The troughs 24 provide lateral stiffening to the edge of the panel and form part of the jointing system.

Two cold-formed, zinc coated steel channel members 30 and 32 form, continuously along the joint, other elements of the jointing system. The channel members 30 and 32 have flange stiffeners and are located in the adjoining troughs 24 of neighbouring panels 10 as shown in FIG. 1. The webs of the channels 30 and 32 are pierced at intervals to allow the passage of threaded members 34 which form part of the panel connection.

The threaded members 34 are threaded along their entire length or, at least, adjacent both of their ends. As shown in FIG. 1, the ends of each pair of threaded members 34 used to secure a single connections are located in an insulating block or spacer 36 shown in FIGS. 2 and 3. The ends of the threaded members 34 are secured in the insulating block by means of suitably threaded nuts 38 which are received in openings 40 formed in the block. Each opening 40 extends transversely of the block and communicates with the inner end of a blind bore 42 through which the end of the respective threaded member 34 passes to engage the nut 38.

Where both faces of the panel 10 are readily accessible, the joint can be assembled as follows.

The innermost end of each pair of threaded members 34 are passed into the opposed blind bores 42 formed at opposite ends of the insulating block or spacer 36. The ends of the threaded members 34 are secured by means of nuts 38 passed into the cross-openings 40. The ends of the threaded members 34 remote from the insulating block are then passed through holes formed in the two opposed channel members 30 and 32. The channel members 30 and 32 are then pushed towards one another so that their flanges locate in the troughs 24 formed by the sheet metal 22 at the edges of both faces of two adjacent panels 10 so that the interengagement of the channels 30 and 32 with the sheet metal troughs at the edges of the panels holds the panels firmly together. The assembly is then secured by means of countersunk nuts 44 which are threaded onto the protruding ends of the threaded members 34. The whole panel connection assembly can then be concealed beneath a U-section capping member 46 which fits over the channel member 30 or 32 and which can be finished to match or contrast with the panel finish.

Where the panel assembly is installed against an existing wall so that one face is relatively inaccessible, the panel 10 last assembled is eased away from its support to position the channel member 30 on the inaccessible face of the panels. The channel member 30 will then span between panel supports and one of the four troughs 24 will be engaged around the channel flange. Any required fixture of the channel member 30 to supporting rails on the existing wall should be made at this stage. The channels 30 which are to be mounted on what will be the inaccessible face of the panel assembly are positioned with the threaded member 34 and nut 46 at that side of the panel connection already in place. If insulated capping is required on the inaccessible face of the panel assembly, the capping is also located on the channel prior to its installation.

Once the channel member at the inaccessible side of the panel assembly is in place the panel connection can be completed as described above.

Ideally, the nuts 44 on the threaded members 34 are tightened until the edges of the pair of neighbouring panels 10 are under slight compression by the pair of opposed channel members 30 and 32 bearing on the sheet metal troughs 24 at the edges of the panels 10. This helps to lock the panels rigidly together and, in particular, helps the assembly to resist thermal bowing under extreme temperature conditions.

To improve the insulating properties of the construction, the spaces between the edges of adjacent panels, between the channel members 30 and 32 may be filled with suitably sized strips of insulating material. Further, the spaces between any capping member 46 and the interior of the troughs 24 at the edges of the panels 10 may be filled with a suitable insulating sealant.

Although the panel assembly shown in FIG. 1 is generally vertical, the panels may be arranged horizontally to form floors or ceilings. If the panels 10 are to form a ceiling, it is unlikely that the top (accessible) face will require capping. Provision for the support of additional panels may be made by using a female-threaded ring eye (not shown) in place of the final assembly nut 44 described above. Such a ring eye and the associated threaded member 34 form a tie through the panel connection which enables the supporting tensile forces to be transmitted through the jointing system to the remote face. These tensile forces may cause damage to insulation panels if transmitted through the panels themselves.

What we claim is:

1. A panel system comprising:

a plurality of panel members, each of which comprises a panel body disposed between and secured to a pair of planar facing members; each of said facing members being shaped so as to define a trough extending along at least one edge surface of said panel body and opening towards the face of the panel body to which said facing member is secured, and means for securing adjacent panel members together edge-to-edge; said means for securing said panel members including first and second channel members each having a pair of arms joined by means of a web, the arms of each channel member, in use, engaging one in each of the troughs formed along the adjacent edge surfaces of a pair of neighbouring panel members; said means for securing adjacent panel members together further comprising first and second fastening means engageable with the first and second channel members respectively and with an insulating spacer, the first and second fastening means and the insulating spacer together extending between neighbouring panel members to fasten together the channel members on opposite sides thereof.

2. Apparatus according to claim 1 in which said troughs are substantially rigid, extending along substantially the whole edge of each facing member, and serve to stiffen the edges of the panel members along which they extend.

3. Apparatus according to claim 1 in which there are secured on opposite faces of said panel members metallic sheets which form said facing members; said troughs being formed by suitably shaped portions of the said sheets which extend beyond said panel body.

4. Apparatus according to claim 3 in which said panel body is of thermally-insulating material.

5. Apparatus according claim 1 further comprising an elongate capping member adapted to fit, in use, over one of the first and second channel members so as to extend substantially flush with the faces of the neighbouring panel members said channel member serves to join.

6. Apparatus according to claim 1, said apparatus further comprising at least one insulating member which, in use, is located between the first and second channel members in a gap defined by adjacent edges of neighbouring panel members.

7. Apparatus according to claim 1 in which said first or second fastening means comprises a threaded member having a first threaded end portion which, in use, passes through an opening formed in the respective first or second channel members, said first end portion being threaded for engagement with a retaining nut and a second end portion which is engageable with said insulating spacer.

8. Apparatus according to claim 1 in which said first or second fastening means comprises a threaded member having a second threaded end portion which, in use, passes through a bore formed in said insulating spacer, said second end portion being threaded for engagement with a retaining nut located in a recess formed therein and a first end portion which is engageable with a respective one of the first or second channel members.

* * * * *